US005767465A

United States Patent [19]

Fulton et al.

[11] Patent Number: 5,767,465

[45] Date of Patent: Jun. 16, 1998

[54] PEDESTRIAN CROSSWALK SWITCH

[75] Inventors: Charles E. Fulton; Loren G. Moberly, both of Spokane; Scott A. Moberly, Edmonds, all of Wash.

[73] Assignee: Dick Campbell Company, Seattle, Wash.

[21] Appl. No.: 918,747

[22] Filed: Aug. 25, 1997

Related U.S. Application Data

[63] Continuation of Ser. No. 509,780, Aug. 1, 1995, abandoned.

[51] Int. Cl.[6] ..... H01H 13/00

[52] U.S. Cl. ..... 200/16 R; 200/520; 200/47; 200/341

[58] Field of Search ..... 40/606, 607, 331, 40/332; 340/31 R, 44; 174/85 R; 200/16 R–16 D, 52 R, 520, 521, 47, 341

[56] References Cited

U.S. PATENT DOCUMENTS

| | | | |
|---|---|---|---|
| 2,707,213 | 4/1955 | Koertge et al | 200/18 |
| 3,576,529 | 4/1971 | Garrison | 340/72 |
| 4,295,017 | 10/1981 | Kashima et al. | 200/47 |
| 4,454,397 | 6/1984 | Kim | 200/296 |
| 4,871,890 | 10/1989 | Herrera | 200/314 |
| 5,077,454 | 12/1991 | Lorenzo | 200/573 |
| 5,495,081 | 2/1996 | Ipcinski | 200/341 |

*Primary Examiner*—Cassandra C. Spyrou
*Assistant Examiner*—Michael A. Friedhofer
*Attorney, Agent, or Firm*—Christensen, O'Connor, Johnson & Kindness PLLC

[57] ABSTRACT

A pedestrian crosswalk switch (140) for registering force applied to a crosswalk button (172) is provided. The pedestrian crosswalk switch (140) includes a button housing (142), a crosswalk button assembly (143) including a compression spring (174), a button coupling assembly (176), and a microswitch assembly (178). The crosswalk button assembly (143) has a button shank (184) that protrudes through the compression spring (174) and into a button aperture (162) of the button housing (142). The button coupling assembly movably couples the crosswalk button (172) via the button shank (184). The microswitch assembly (178) has a movable trigger (196) and a compression spring (198) pivotally mounted to a microswitch (194) by a pivot pin (202). The microswitch assembly (178) is mounted to a flange (168) protruding from the button housing (142) such that the trigger (196) is in engaging alignment with the button coupling assembly (176). Depression of the crosswalk button forcibly moves the button coupling assembly (176) into engaging contact with the trigger (196), creating input for the microswitch, which notifies traffic control apparatus (not shown) that a change in the crosswalk signal is requested. The provided pedestrian crosswalk switch provides an efficient and low-cost design, meeting existing guidelines for crosswalk switch functionality, while reducing disadvantages inherent in existing pedestrian crosswalk switches.

5 Claims, 4 Drawing Sheets

PEDESTRIAN CROSSWALK SWITCH

This application is a continuation application of application Ser. No. 08,509,780, filed on Aug. 1, 1995 now abandoned.

FIELD OF THE INVENTION

The present invention generally relates to switches and, more specifically, to pedestrian crosswalk switches.

BACKGROUND OF THE INVENTION

Known pedestrian crosswalk switches include a housing for mounting to a pole or other elevated support, a crosswalk button movably coupled to the housing, and a switching means mounted to the housing and positioned such that the crosswalk button, when depressed, engages the switching means in such a way so as to actuate the switching means, thereby indicating to a traffic control system that a pedestrian is awaiting a light change at a crosswalk.

One prior art pedestrian crosswalk switch 10, shown in FIGS. 1A and 1B, includes a generally cylindrical housing 12 having an outer face 14. A semicircular protrusion 18 extends outward from the outer face 14. A button aperture 20 is located at the center of the circular area defined by the semicircular protrusion 18. Four mounting apertures 22 are located along the peripheral margin of the housing 12, spaced 90 degrees apart. As best understood by reference to FIG. 1B, the inner face 16 of the housing is recessed from a cylindrical wall 24 defining the edge of the housing. Protruding from the recessed inner face 16 are the walls defining the button aperture 20 and the four mounting apertures 22. In addition, two additional protruding walls define threaded apertures 26 for screws 32 which mount a bracket 28 to the housing. A microswitch 34 having a protruding button 36 is affixed to the bracket 28 by bolts 38. The button 36 extends through the housing button aperture 20 so as to protrude beyond the outer face 14 of the housing, and is spring biased outward by a spring mechanism internal to the microswitch. The microswitch 34 is connected to traffic control apparatus (not shown) by rear switch terminals 39. In operation, the prior art pedestrian crosswalk switch 10 receives input from a pedestrian by pressure applied to the button 36, which in turn notifies the traffic control apparatus (not shown) that a signal change is requested.

In the prior art pedestrian crosswalk switch 40 shown in FIGS. 2A and 2B, a generally rectangular housing 42 has an outer face 44 with a cylindrical protrusion 48 that defines a circular recess 49. Four mounting apertures 50 extend through the housing 42, one near each corner.

As seen in FIG. 2B, the housing 42 has an inner face 46 that includes an inward extending button protrusion 52 having a central bore. The inner portion of the bore is threaded, whereas the outer portion of the bore is not. In addition, the outer portion of the bore has a diameter less than the diameter of the inner portion of the bore, defining an annular shoulder 58 between the two bore portions. Crosswalk switch 40 further includes an actuator button 56 having a shank 62 slidably received in the outer portion of the bore of the protrusion 52, and retained therein by a coupling washer 65 secured to the shank by a screw 64. A microswitch 66 has external threads for mounting in the inner portion of the bore of protrusion 52. Such switch includes an outward projecting actuator 68 with an outer end adjacent to the inner end of the button shank 62. Actuator 68 is biased outward by an internal spring (not shown). Internal force applied to the crosswalk button 56 results in movement of the button shank and the adjacent microswitch actuator 68. The microswitch 66, which is connected to traffic control apparatus (not shown) by rear switch terminals 70, in turn notifies the traffic control apparatus that a signal change is requested.

Yet another prior art pedestrian crosswalk switch 74 is shown in FIGS. 3A and 3B. Such switch includes a rectangular housing 76 having an outer face 78 with a cylindrical protrusion 82. Protrusion 82 defines a circular recess 84. Four mounting apertures 86 are located near the corners of the rectangular housing 76.

As seen in FIG. 3B, the housing 76 has an inner face 80 that is recessed with respect to its peripheral wall 88. The inner face 80 further includes bracket studs 90 extending inward and having threaded bores for screws 100 which mount a bracket 94 to the housing 76. The bracket 94 is rectangularly shaped so as to fit closely within the peripheral wall 88 of the housing 76. A resilient seal 101 is sandwiched between the housing 76 and bracket 94. Bracket 94 further includes an inner rectangular subhousing 102 having two contact arms 104 which are electrically connected to traffic control apparatus (not shown).

Pedestrian crosswalk switch 74 further includes a button 108 having a convex exterior 110 and a concave interior 112. The button 108 further includes a shank 114 protruding inward from the concave interior 112 through a central housing button aperture 93 and an aligned button aperture 106 of the bracket 94. An outer contact washer 128, bushing 122, compression spring 126, and inner stop washer 120 are mounted to the button shank by a screw 130. An inner compression spring 118, engaged between the bracket 94 and button 108, biases the button outward. The contact arms 104 are located directly above contact washer 128, straddling the screw 130. As inward force is applied to the button 108, the contact washer 128 makes an electrical connection between contact arms 104, thereby notifying the traffic control apparatus (not shown) that a signal change is requested.

By virtue of the spring designs, bracket assemblies, and microswitch choices of the prior art pedestrian crosswalk switches, the prior art crosswalk switches require substantial materials, components, and relatively complex microswitch engagement designs to effectuate their purpose. These factors create inefficiencies that result in added costs and, sometimes, unreliable crosswalk switches. Furthermore, under recent specific guidelines seeking to accommodate Americans with disabilities, stringent specifications as to aspects of pedestrian crosswalk switches, including the size of the crosswalk button and the force required to operate the crosswalk button, have been set forth, further highlighting the inadequacies of the existing crosswalk switches. Beyond the inefficiencies and expense associated with the types of designs being used by existing pedestrian crosswalk switches, many such crosswalk switches have been shown to be unreliable in meeting these specifications. The present invention is directed to overcoming these disadvantages.

SUMMARY OF THE INVENTION

The present invention provides a pedestrian crosswalk switch operable by application of force to a crosswalk button. In the preferred embodiment, the switch includes a button housing having an exterior face, an opposite interior face, and a button aperture extending between the two faces. A crosswalk button having an exterior face, an interior face, and a shank slidably received in the button aperture and having an inner end is movably coupled to the button housing. A button spring is positioned between the interior face of the crosswalk button and the exterior face of the button housing for biasing the crosswalk button outward away from the button housing and for normally maintaining the exterior face of the crosswalk button a predetermined distance from the exterior face of the button housing. A microswitch is mounted to the interior face of the button housing and has a movable trigger aligned with the inner end of the button shank, such that inward movement of the crosswalk button by force applied against its exterior face causes the inner end of the button shank to move the trigger to actuate the microswitch.

In accordance with further aspects of this invention, the button shank includes a step-down shoulder facing inward and defining a larger diameter portion of the shank, such that the shoulder is located approximately midway between the interior face of the button and the inner end of the shank, and the button spring is positioned between the step-down shoulder of the button shank and the exterior face of the button housing.

In accordance with still other aspects of this invention, the inner end of the shank has a coupling aperture and the crosswalk button is movably coupled to the button housing by a coupling means affixed to the button shank on the interior face of the button housing by use of the coupling aperture.

In accordance with yet other aspects of this invention, the button housing includes a flange protruding from its interior face to which the microswitch is mounted.

As will be appreciated from the foregoing summary, the present invention provides a pedestrian crosswalk switch that incorporates an efficient design with minimal components to achieve reliable switching in accordance with governmental guidelines, while reducing the disadvantages inherent in the design of prior art pedestrian crosswalk switches of the type shown in FIGS. 1–3. In particular, the use of a reliable microswitch having a lever-actuated plunger increases reliability of the switching device and decreases disadvantages described above. In essence, the pedestrian crosswalk switch of the present invention is a more streamlined, efficient, and reliable crosswalk switch than those switches of the type shown in FIGS. 1–3.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1A:
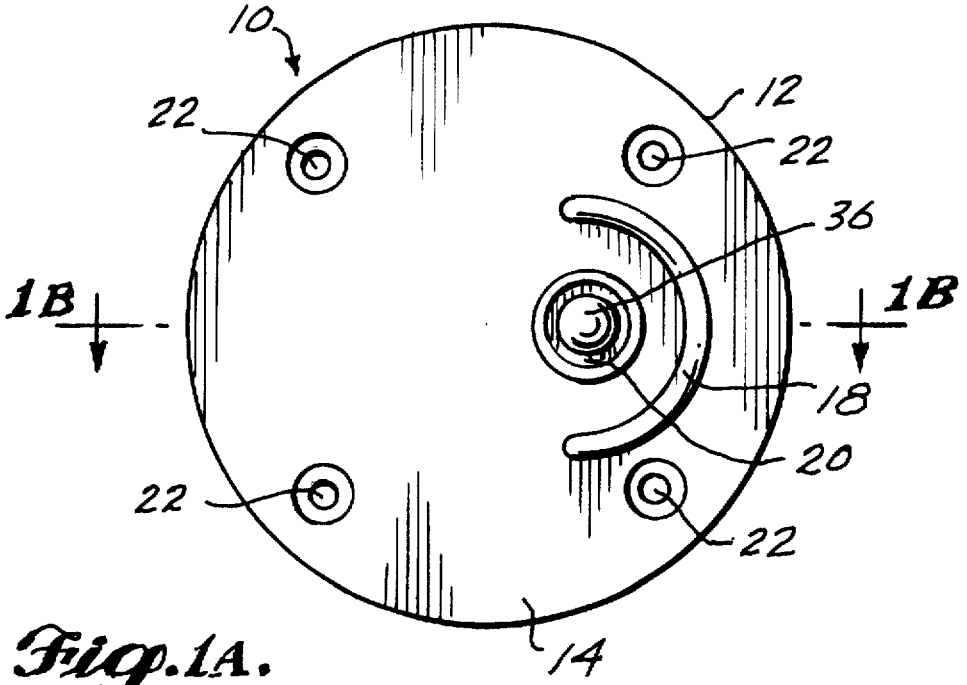
Fig. 1A. (PRIOR ART)
FIG. 1A is a front elevation of a prior art pedestrian crosswalk switch.
Figure 1B:
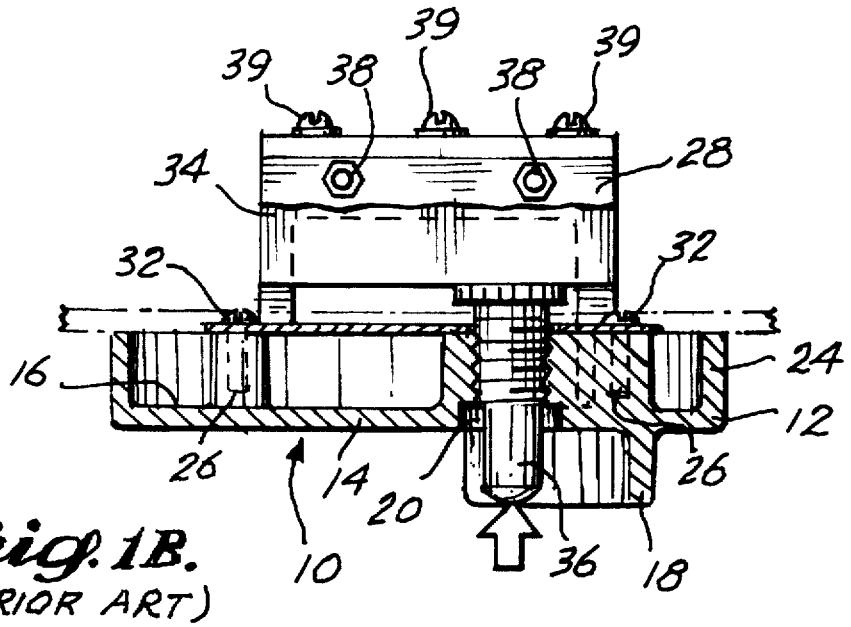
Fig. 1B. (PRIOR ART)
FIG. 1B is a section along line 1B—1B of FIG. 1A.
Figure 2A:
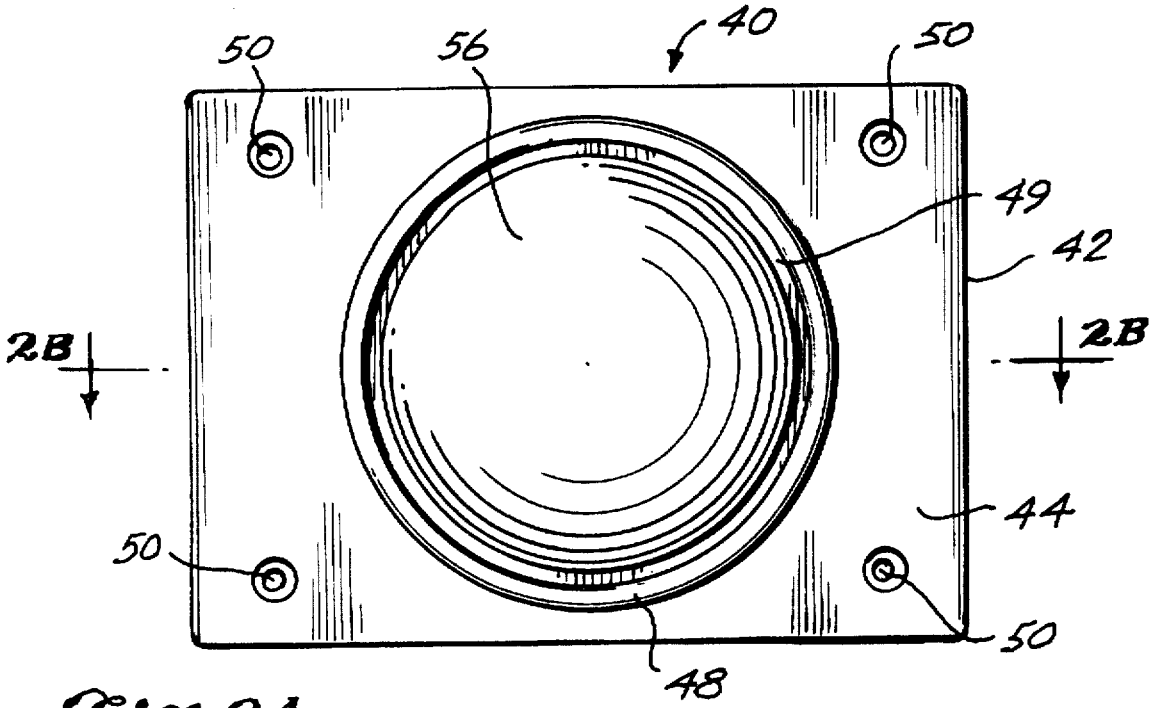
Fig. 2A. (PRIOR ART)
FIG. 2A is a front elevation of a second prior art pedestrian crosswalk switch.
Figure 2B:
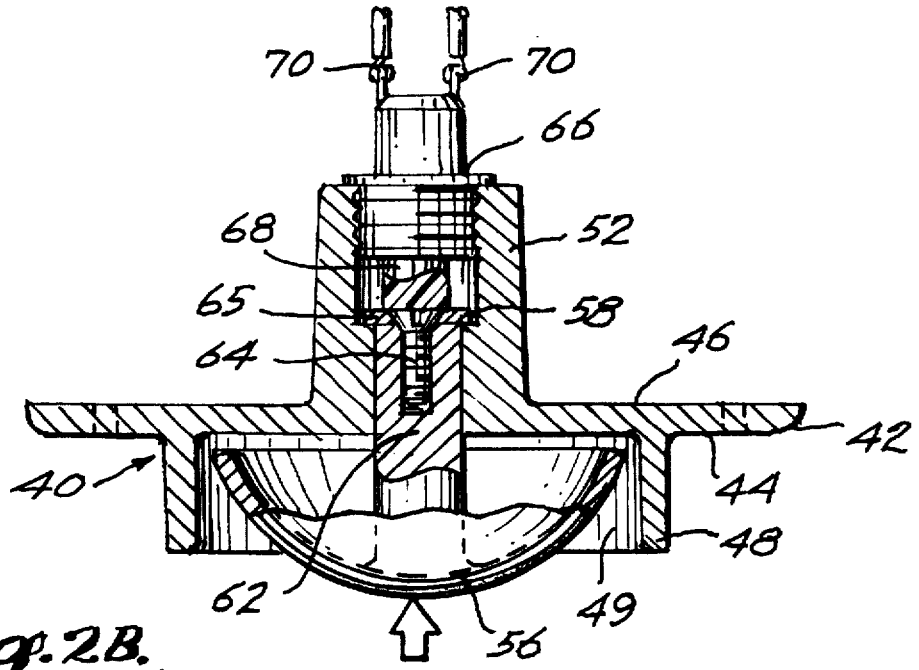
Fig. 2B. (PRIOR ART)
FIG. 2B is a section along line 2B—2B of FIG. 2A.
Figure 3A:
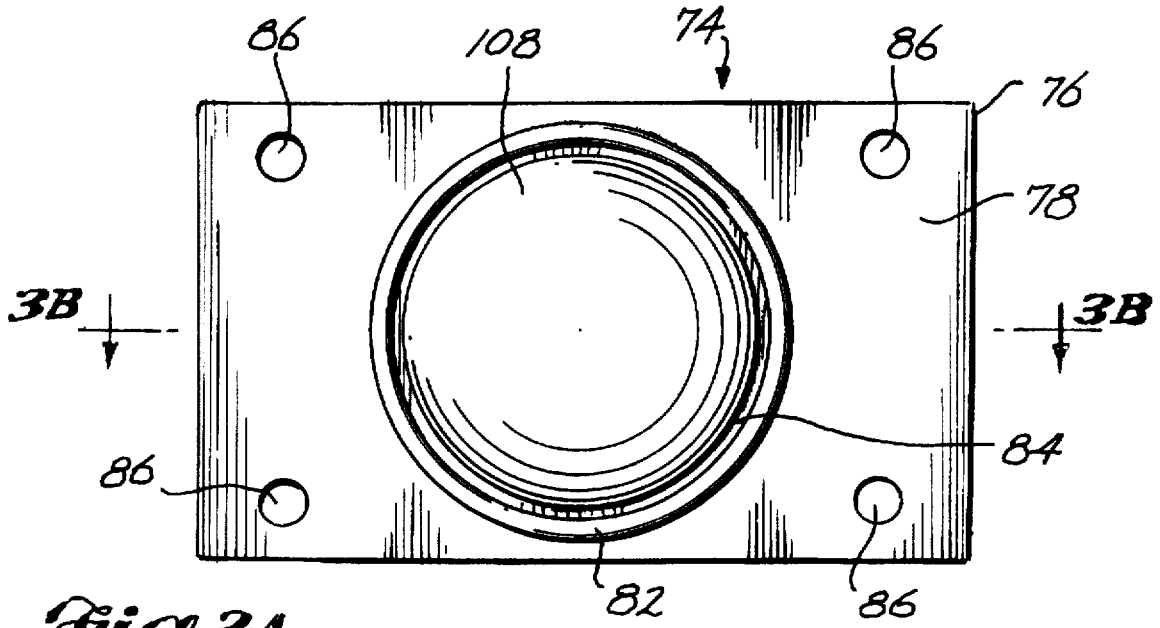
Fig. 3A. (PRIOR ART)
FIG. 3A is a front elevation of a third prior art pedestrian crosswalk switch.
Figure 3B:
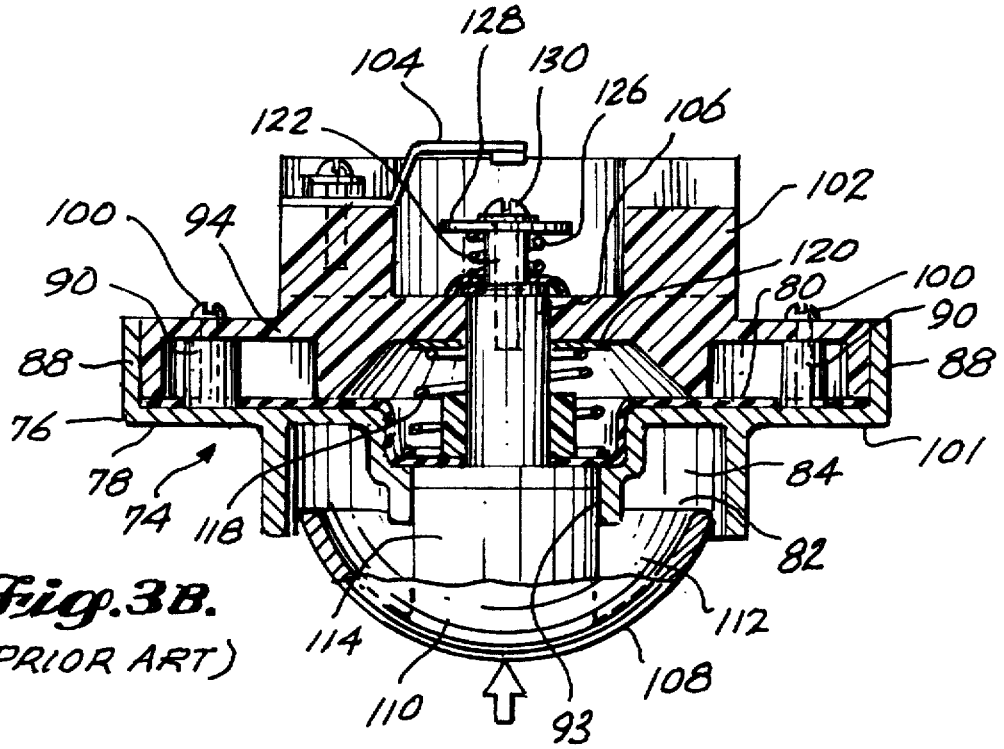
Fig. 3B. (PRIOR ART)
FIG. 3B is a section along line 3B—3B of FIG. 3A.
Figure 4:
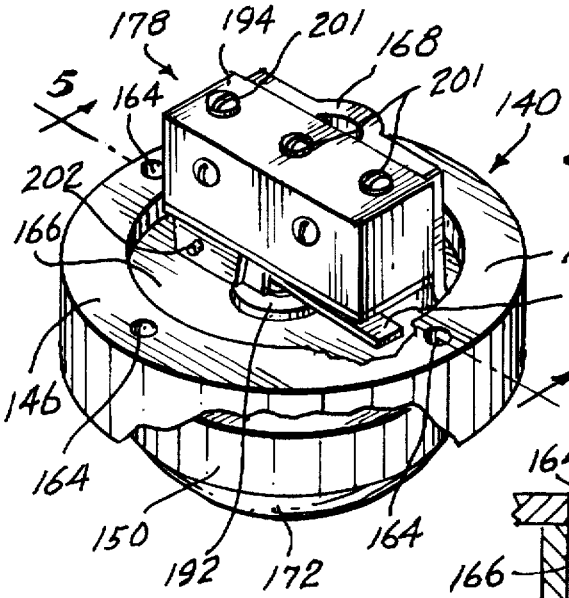
FIG. 4 is a top perspective of a pedestrian crosswalk switch in accordance with the present invention.
Figure 5:
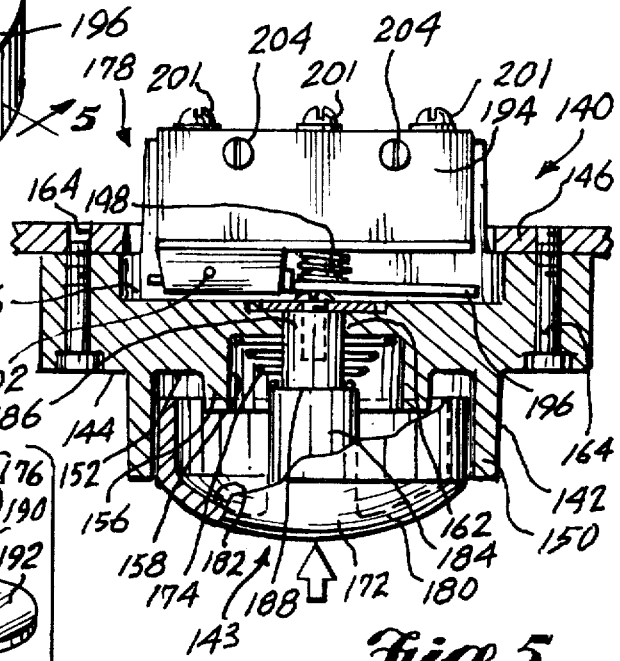
FIG. 5 is a section along line 5—5 of FIG. 4.
Figure 6:
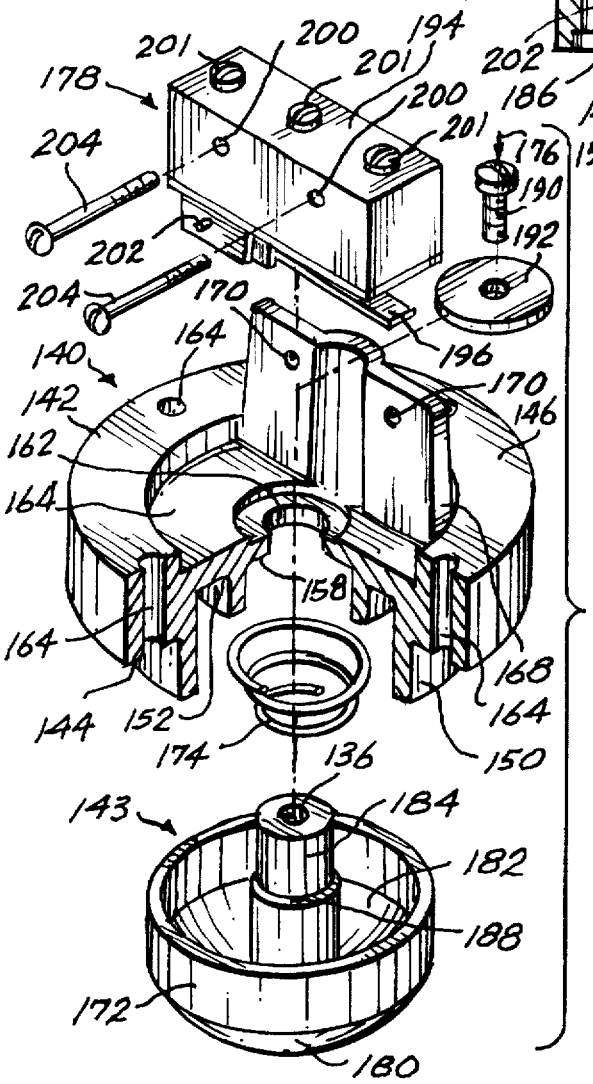
FIG. 6 is a top perspective of the pedestrian crosswalk switch of FIG. 4 with parts shown in exploded relationship.

An embodiment of a pedestrian crosswalk switch 140 made in accordance with the present invention is illustrated in FIGS. 4–6. In general, the pedestrian crosswalk switch 140 includes a cylindrical housing 142, a crosswalk button assembly 143, and a microswitch assembly 178.

The cylindrical housing 142 of the pedestrian crosswalk switch 140 has an exterior face 144 and an interior face 146. The exterior face 144 includes a centrally located outer cylindrical protrusion 150 and a shorter concentric inner cylindrical button protrusion 156, defining an annular recess 152 between the protrusions and an inner circular recess 158. A button aperture 162 extends through the center of the housing, i.e. at the center of the inner recess. The housing 142 also has four mounting apertures 164 located outward of protrusions 150 and spaced 90 degrees apart.

The interior face 146 of the housing 142 has a shallow recess 166 and a projecting flange 168 offset from the button aperture 162. The recess is substantially semicircular and surrounds the button aperture. Flange 168 defines the straight edge boundary of the semicircular recess. Two threaded microswitch bracket mounting apertures 170 are formed in the flange toward its edge remote from the interior face 146 of the housing 140.

The crosswalk button assembly 143 of the pedestrian crosswalk switch 140 includes a button 172, a helical compression spring 174, and a button coupling assembly 176. The button 172 has a convex exterior 180, a concave interior 182, and a stepped shank 184 protruding inward from the concave interior. The larger diameter portion of the stepped shank is located at the interior side of the button, thereby forming an annular shoulder 188 facing inward. Such shoulder is located approximately midway between the concave interior 182 and the inner end of the shank. Such inner end has a blind threaded coupling aperture 186.

One end of the compression spring 174 engages against shoulder 188. At its opposite end, the spring 174 engages the interior recess 158 of the exterior face 144. The button spring 174 maintains the position of the crosswalk button at a predetermined distance from the housing 142 and provides a force to counteract pressure applied to the crosswalk button. As pressure is applied to the crosswalk button, the button spring 174 is compressed, and the button shank 184 of the crosswalk button is forced into the straight button aperture 162 from the exterior face to the interior face of the housing, such that the button coupling aperture 186 is exposed on the interior face of the button housing.

The button coupling assembly 176 is comprised of a coupling screw 190 which secures a coupling washer 192 to the inner end of the button shank via the coupling aperture 186. Washer 192 projects beyond the periphery of the shank to engage the interior face of the housing and limit outward sliding of the crosswalk button by force of the spring. With the crosswalk button depressed and the button member protruding through the interior face of the button housing, the coupling screw 190 and coupling washer 192 are secured to the button via the threaded button coupling aperture 186.

The microswitch assembly 178 includes a microswitch 194, a switch arm or trigger 196, and a compression spring 198. The microswitch 194 is a switching device used to signal the position of the trigger by opening or closing the path between switch terminals 201, such as those readily available from a number of commercial sources known to those skilled in the art. The microswitch includes two mounting apertures 200 corresponding to the microswitch bracket mounting apertures 170 of the integral housing flange 168. The trigger is pivotally mounted to the microswitch 194 by means of a pivot pin 202. The microswitch assembly 178 is mounted to the housing flange 168 by mounting screws 204.

In operation, as the crosswalk button 172 is forcibly depressed by a pedestrian awaiting a crosswalk signal, the spring 174 is compressed against the interior button recess 158 of the button housing 142. The button shank 184 slides through the button aperture 162 toward the plunger 196 of the microswitch assembly 178. When sufficient force is applied to the crosswalk button, the screw 190 coupled to the button shank 184 swings the switch trigger about the pivot pin 202 so as to compress the plunger spring 198, actuating the microswitch 194. Actuation of the microswitch, which senses whether there is an open circuit or a closed circuit between the switch terminals 201, signals associated traffic control apparatus (not shown), which in turn issues a priority request to change the crosswalk signal.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A pedestrian crosswalk switch, comprising:

(a) a button housing having an exterior face, an interior face, and a button aperture extending between the housing faces;

(b) a crosswalk button having an exterior face, an interior face, and a shank that is slidably received in the button aperture so that an inner end of the shank extends through the button housing, the shank including a shoulder that defines a smaller diameter portion of the shank and a coupling aperture that extends into the inner end of the shank, the crosswalk button being slidably coupled to the button housing by a coupler that extends through the button aperture and is received within the coupling aperture;

(c) a button spring positioned between the shoulder and the interior face of the button housing and biasing the crosswalk button outward away from the button housing and maintaining the exterior face of the crosswalk button a predetermined distance from the exterior face of the button housing; and (d) a microswitch mounted to the button housing, the microswitch having a body and a spring-biased pivotable actuation lever connected to the body at a pivot point, the shank of the button being contactable with the pivotable actuation lever adjacent the pivot point to switch the microswitch when the shank of the button is moved toward the microswitch.

2. The pedestrian crosswalk switch of claim 1, wherein the coupler includes a screw.

3. The pedestrian crosswalk switch of claim 1, wherein:

(a) the button housing further includes a flange protruding from the interior face of the button housing; and wherein (b) the microswitch is coupled to the flange.

4. A pedestrian crosswalk switch, comprising:

(a) a button housing having an exterior face, an interior face, and a button aperture extending between the housing faces;

(b) a crosswalk button having an exterior face, an interior face, and a shank that is slidably received in the button aperture so that an inner end of the shank extends through the button housing, the shank including a shoulder that defines a smaller diameter portion of the shank and a coupling aperture that extends into the inner end of the shank, the crosswalk button being slidably coupled to the button housing by a coupler that extends through the button aperture and is received within the coupling aperture;

(c) a button spring positioned between the shoulder and the interior face of the button housing and biasing the crosswalk button outward away from the button housing and maintaining the exterior face of the crosswalk button a predetermined distance from the exterior face of the button housing; and (d) a microswitch mounted to the button housing, the microswitch having a body, a pivotable actuation lever and a spring biasing the pivotable actuation lever, the spring being coaxially aligned with the shank of the button.

5. A pedestrian crosswalk switch, comprising:

(a) a button housing having an exterior face, an interior face, and a button aperture extending between the housing faces;

(b) a crosswalk button having an exterior face, an interior face, and a shank that is slidably received in the button aperture so that an inner end of the shank extends through the button housing, the shank including a shoulder that defines a smaller diameter portion of the shank and a coupling aperture that extends into the inner end of the shank, the crosswalk button being slidably coupled to the button housing by a coupler that extends through the button aperture and is received within the coupling aperture;

(c) a button spring positioned between the shoulder and the interior face of the button housing and biasing the crosswalk button outward away from the button housing and maintaining the exterior face of the crosswalk button a predetermined distance from the exterior face of the button housing; and (d) a microswitch mounted to the button housing, the microswitch having a body, a pivotable actuation lever connected to the body at a pivot point, and a spring biasing the pivotable actuation lever, the spring being coaxially aligned with the shank of the button, the shank of the button being contactable with the pivotable actuation lever adjacent the pivot point to switch the microswitch when the shank of the button is moved toward the microswitch.

* * * * *